United States Patent [19]

Smith

[11] 4,117,433

[45] Sep. 26, 1978

[54] STATIC CONVERGENCE DEVICE INCLUDING MAGNETIC CORRECTOR APPARATUS

[75] Inventor: Joseph Leland Smith, Indianapolis, Ind.

[73] Assignee: RCA Corporation, New York, N.Y.

[21] Appl. No.: 790,198

[22] Filed: Apr. 25, 1977

[51] Int. Cl.[2] ..... H01F 7/00

[52] U.S. Cl. ..... 335/212

[58] Field of Search ..... 335/212

[56] References Cited

U.S. PATENT DOCUMENTS

| | | | |
|---|---|---|---|
| 3,898,597 | 8/1975 | Vonk | 335/212 |
| 4,045,754 | 8/1977 | Barten | 335/212 |

*Primary Examiner*—Harold Broome

*Attorney, Agent, or Firm*—Eugene M. Whitacre; Paul J. Rasmussen; Joseph Laks

[57] ABSTRACT

A static convergence device for statically converging first and second electron beams within an envelope of a cathode ray tube comprises an adjustable first magnetic apparatus, adjustment of which moves at least one of the electron beams in a direction and with a magnitude of motion to converge them to within a first distance of each other for selected conditions of misconvergence. The apparatus produces a motion of minimum magnitude of at least one of the electron beams for all adjustments of its magnetic field. The apparatus is unable to converge the electron beams to within the first distance for all of the various conditions of misconvergence. The static convergence device also includes adjustable magnetic corrector apparatus suitable for locating about a portion of the envelope for producing a second magnetic field of fixed magnetic field strength and adjustable direction for effecting motion of a substantially fixed magnitude of at least one of the electron beams in a direction that will offset the motion of minimum magnitude produced by the first magnetic apparatus for enabling the first magnetic apparatus to converge the electron beams to within the first distance for all of the various conditions of misconvergence.

6 Claims, 7 Drawing Figures

STATIC CONVERGENCE DEVICE INCLUDING MAGNETIC CORRECTOR APPARATUS

BACKGROUND OF THE INVENTION

This invention relates to static convergence apparatus for cathode ray tubes for color television receivers.

Color display systems such as utilized in color television receivers include a cathode ray tube in which three electron beams are modulated by color-representative video signals. The beams impinge on respective color phosphor areas on the inside of the tube viewing screen. To accurately reproduce a color scene, the three beams must be substantially converged at the screen at all points on the raster. The beams may be converged at points away from the center of the raster by utilizing dynamic convergence methods or self-converging techniques, or a combination of both. Regardless of the methods utilized to achieve convergence while the beams are deflected, some provision must be made to statically converge the undeflected beams at the center of the screen. Static convergence devices are necessary because the effect of tolerances in the manufacture of electron beam guns and their assembly into the cathode ray tube neck frequently results in a static misconvergence condition.

Some static convergence devices, used, for example, in in-line beam color kinescopes, converge the outer beams of the three in-line beams onto the central beam by means of four and six pole magnetic field ring pairs, producing opposite and like movements, respectively, of the outer beams, as described in U.S. Pat. No. 3,725,831, granted to R. L. Barbin. Other static convergence devices, such as described in U.S. patent application Ser. No. 698,464, filed on June 21, 1976, for J. L. Smith, provide for individual motion in any direction of each outer beam of three in-line beams by means of two eccentrically located magnetic ring pairs.

For each of the above static convergence devices, the motion described by a given electron beam is controlled in magnitude by equal and opposite rotation of each ring member of the appropriate ring pair. For example, a static convergence device described in the aforementioned Smith application has a magnetic ring pair comprising illustratively a six-pole configuration with an internal zero magnetic field point located between the center and one outer beam to effect motion of the other outer beam.

For relatively poorly converged cathode ray tubes, where one outer beam is at a relatively great distance from the center beam, a large magnitude motion of the outer beam is required in order to converge it to within an acceptable distance of the center beam. To accomplish such large magnitude motions, the ring members of the appropriate ring pair are rotated relative to each other so that the magnetic field of each member is aligned additively with the field of the other rather than in a cancelling orientation. The maximum resultant magnetic field, corresponding to maximum motion of the electron beam, occurs when a North pole of one ring member is directly aligned with the North pole of the other ring member.

Minimum motion of the electron beam occurs when a North pole of one ring member is aligned with a South pole of the other ring member, the fields of one cancelling the effect on the electron beam of the other. This minimum magnitude motion cannot be reduced below a certain value. Tolerances in the manufacture of the magnetic ring members and their incorporation into a static convergence structure will result in one ring member having slightly different properties than the other ring member, such as slightly different pole strengths and locations of the poles within the ring pair structure.

Another factor influencing the minimum magnitude of motion that a static convergence structure will produce is the location of the structure along the central Z-axis of the cathode ray tube. Because the velocity of the electron beams increases with increasing Z-axis distance from the electron guns, the magnetic fields of the static convergence device will produce different transverse magnetic forces depending where these fields are located along the Z-axis. Each ring member of a ring pair is located at a slightly different Z-axis location than is the other member. Thus, even if the ring members are rotated into a cancelling orientation, the magnetic field of one ring member, having a slightly different effect on the electron beam than the other, will not completely cancel the motion produced by the other ring member, this despite their similar structure. Static convergence structures located behind the G3 or G4 electrodes of the electron guns are therefore relatively more sensitive to the above-described velocity dependent effect than are static convergence devices further forward of the guns.

As thusly described for various reasons, regardless of the adjustments made to the static convergence device, a minimum magnitude motion of one electron beam relative to another will result. Since the electron beams will be subject to various conditions of misconvergence due to cathode ray tube manufacturing tolerances, converging an electron beam to within an acceptable distance of another will be possible for only selected conditions of misconvergence but not for all of the various conditions of misconvergence that may be encountered.

For example, a typical desirable capability of a static convergence device is to converge an outer beam onto the central beam to within 0.127mm distance. Consider then, illustratively, the appropriate ring pair of a static convergence device as described in the aforementioned Smith application. Because of the particular tolerances in device manufacture and Z-axis device location, the ring pair may produce a minimum magnitude motion of the outer beam of 0.762mm regardless of the rotational orientation of the ring members. Then, for those misconverged cathode ray tubes where the outer beam relative to the center beam is misconverged by 0.635mm or less, the static convergence device is unable, without additional structure, to converge the beams to within the required 0.127mm distance.

Additional structure associated with a static convergence device is described in U.S. patent application Ser. No. 667,834, filed Mar. 17, 1976, for R. L. Barbin. The purpose of this additional structure, illustratively used in conjunction with the static convergence device of the aforementioned U.S. patent of Barbin, is to provide for shortened operator setup time. The additional structure comprises a nonadjustable four-pole and a nonadjustable six-pole ring member fixedly located about a portion of the kinescope envelope. The fields produced by this arrangement move the outer beams in a predetermined direction relative to the center beam and place the outer beams in predetermined quadrants, regardless of the original misconverged locations of the beams. The operator will always know the manner in which to rotate the ring pairs of the remaining device structure, thereby shortening operator setup time. Such additional structure, however, is not suitable for enabling the static convergence device structure to converge electron beams to within an acceptable distance of each other for all of the various conditions of misconvergence that are encountered in cathode ray tube manufacture.

SUMMARY OF THE INVENTION

A static convergence device for statically converging first and second electron beams within an envelope of a cathode ray tube, the electron beams being subject to various conditions of misconvergence, comprises an adjustable first magnetic apparatus, adjustment of which moves at least one of the electron beams in a direction and with a magnitude of motion to converge them to within a first distance of each other for selected conditions of misconvergence. The apparatus produces a motion of minimum magnitude of at least one of the electron beams for all adjustments of its magnetic field, wherein the apparatus is unable to converge the electron beams to within the first distance for all of the various conditions of misconvergence. The static convergence device also includes adjustable magnetic corrector apparatus suitable for locating about a portion of the envelope for producing a second magnetic field of fixed magnetic field strength and adjustable direction for effecting motion of a substantially fixed magnitude of at least one of the electron beams in a direction that will offset the motion of minimum magnitude produced by the first magnetic apparatus for enabling the first magnetic apparatus to converge the electron beams to within the first distance for all of the various conditions of misconvergence.

DESCRIPTION OF THE INVENTION

Figure 1:
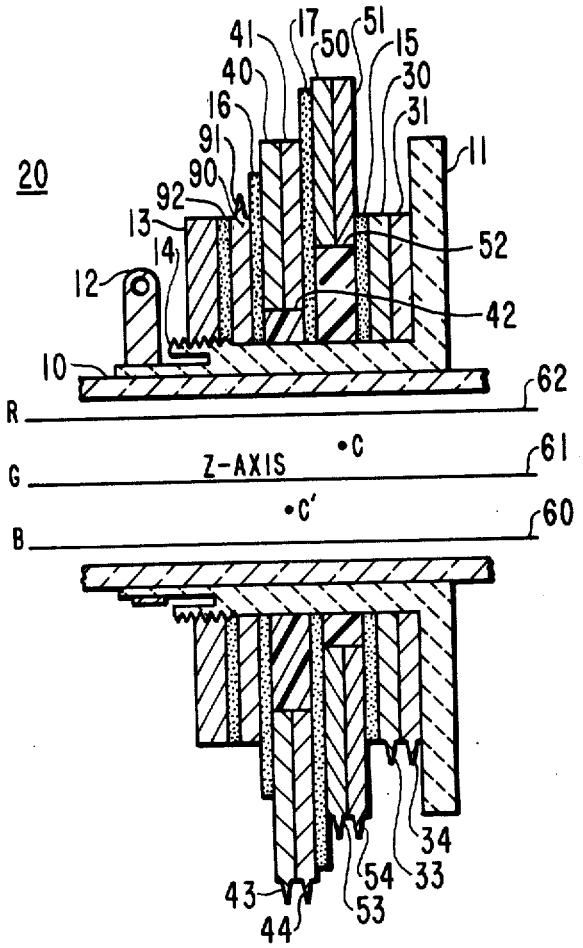
FIG. 1 is a cross-sectional view of a static convergence device embodying the invention.

In FIG. 1, a static convergence device, which includes an embodiment of the invention, comprises a sleeve 11 mounted on a neck portion 10 of a cathode ray tube envelope, not shown, of a color television receiver. A clamp 12 holds the sleeve 11 tightly against the neck 10.

The undeflected paths of three in-line beams 60, 61 and 62 are shown within the neck 10, corresponding to the electron beams emitted from the blue, green and red guns of a tri-beam in-line electron gun arrangement, not shown. The green beam is the one illustratively shown as coincident with the central axis Z of the tube. Other in-line arrangements may also be used.

Static convergence device 20 includes a pair of magnetic ring members 50 and 51 with tabs 53 and 54 for moving the blue beam 60 in any direction without substantially moving the other two beams, as is described in the aforementioned Smith application. The center C of magnetic ring members 50 and 51 is eccentrically located from the central axis by means of an eccentric collar 52 and is located between the green and red beams 61 and 62. Magnetic ring members 50 and 51 are rotationally adjustable about the neck 10.

Static convergence device 20 also includes a pair of magnetic ring members 40 and 41 with tabs 43 and 44 for moving the red beam 62 in any direction without substantially moving the other two beams. The center C′ of magnetic ring members 40 and 41 is eccentrically located from the central axis by means of an eccentric collar 42 and is located between the blue and green beams 60 and 61. Magnetic ring members 40 and 41 are rotationally adjustable about the neck 10. A washer 17 separates the two pairs of magnetic ring members 50–51 and 40–41. A washer 16 is located adjacent ring member 40.

Located on sleeve 11 are a pair of rotatable magnetic purity ring members 30 and 31 with tabs 33 and 34, each of which may be of a conventional two-pole diametrically magnetized, opposite pole design. Rotation of magnetic purity ring members 30 and 31 causes movement of all three of the in-line beams in the same direction. Magnetic ring members 30 and 31 are separated by a washer 15 from magnetic ring members 50 and 51.

Figure 2:
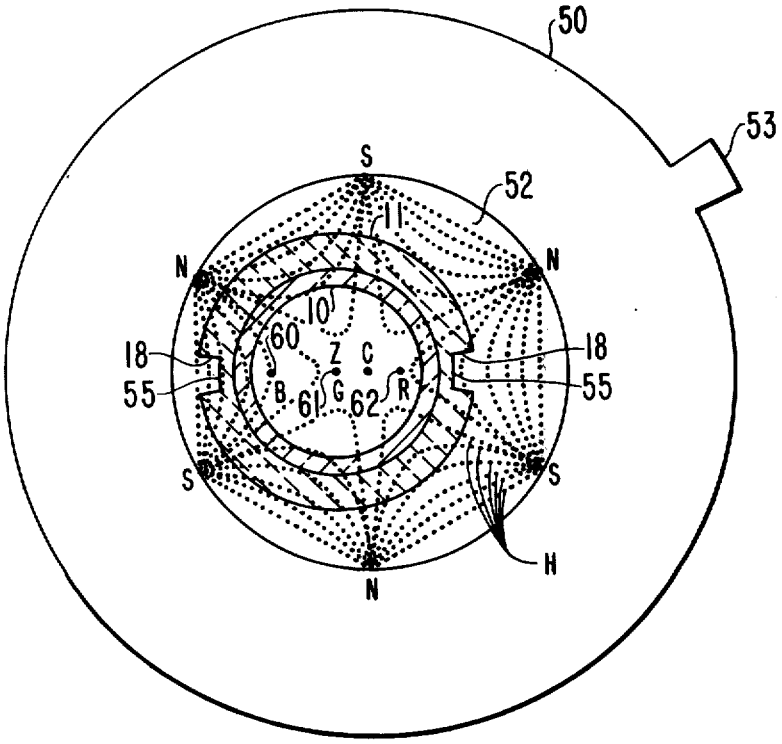
FIG. 2 is a face-view of an embodiment of a magnetic beam moving apparatus included in the device of FIG. 1.

FIG. 2 is a face-view of a magnetic ring member 50. Diametrically opposed grooves 18 in sleeve 11 engage corresponding projections 55 of eccentric collar 52 in order to maintain the eccentric collar in a fixed relationship to the sleeve. Ring member 50 is illustratively shown in FIG. 2 as having a six-pole magnetic configuration with magnetic field lines H. An internal zero magnetic field point is located at the center C of ring member 50. The magnetic field around point C encompassing the red and green beams 61 and 62 is of relatively low field strength and substantially no movement of these beams are produced. The magnetic field around point B is relatively strong, and desired movement of the blue beam can be produced by the appropriate adjustment of the eccentrically located ring pair comprising members 50 and 51. Operation of the eccentrically located ring pair comprising ring members 40 and 41 for effecting movement of only the red beam is similar to that just described. Although ring members 40, 41, 50 and 51 are illustratively six-pole configurations, other appropriate configurations may be used as described in the aforementioned Smith application.

Figure 3:
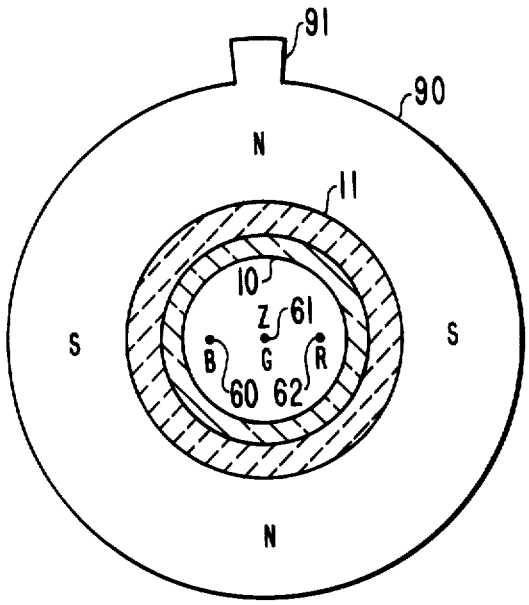
FIG. 3 is a face-view of an embodiment of a magnetic corrector apparatus included in the device of FIG. 1.

Static convergence device 20 also includes structure which permits converging of the electron beams to within an acceptable distance of each other for all of the various conditions of misconvergence that are encountered in cathode ray tube manufacture. An adjustable magnetic corrector apparatus comprising a ring member 90 with a tab 91 for rotational adjustment is concentrically located about the neck 10. A spacer 92 separates corrector 90 from a locking collar 13. Locking collar 13 fits over sleeve 11 and mates with the threads 14 to lock all the ring members in position after they are properly adjusted. Any other suitable locking arrangement may also be used. Corrector 90 produces a magnetic field of fixed field strength and adjustable direction. As shown in FIG. 3, corrector 90 comprises illustratively four magnetic poles of alternating polarity, equiangularly located around the ring periphery.

Figure 4:
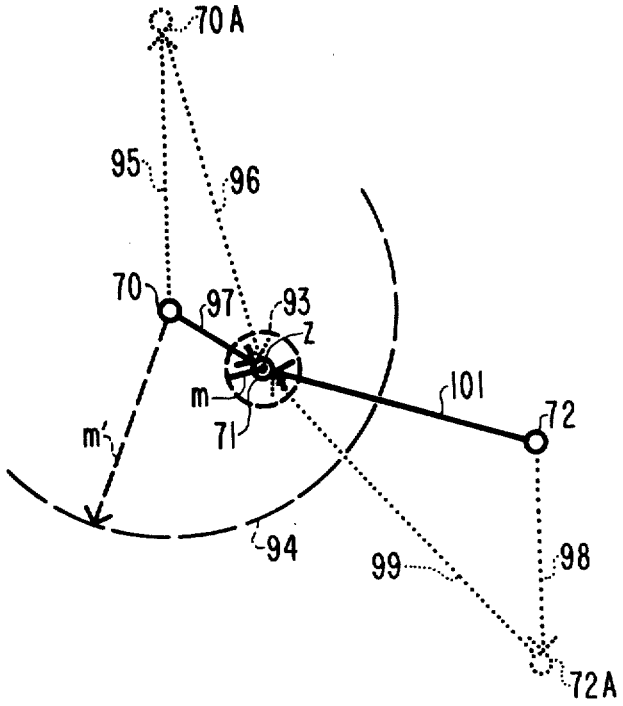
FIGS. 4–7 are schematic diagrams of the effects on selected electron beams produced by various parts of a static convergence device according to the invention.

Consider a typical misconverged condition illustrated in FIG. 4. Blue beam 60 has landed on the phosphor screen of the cathode ray tube at position 70, the red beam 62 at position 72. The green beam 61 is shown for convenience to have landed in position 71 on the central axis Z. This latter result may be achieved before convergence by appropriate rotation of purity ring members 30 and 31 if necessary. If an acceptable criterion of convergence is to move beams 70 and 72 to within a distance m of the center beam 71, then static convergence device 20 must be able to move an outer beam 70, for example, to within circle 93. Without corrector 90, such a result can be accomplished for only selected conditions of misconvergence.

The direction of outer blue beam 70 motion is controlled by rotating ring pair members 50 and 51 together. The magnitude of motion is determined by equal and opposite rotation of each of the members. As mentioned previously, because of the different Z-axis locations of ring members 50 and 51, and because of device manufacturing tolerances, the minimum motion that can be imparted by members 50 and 51 operating as a ring pair is m'. Thus, regardless of the rotational adjustment of the ring pair, beam 70 is moved to positions outside of circle 94; acceptable convergence cannot be obtained.

By including a magnetic corrector ring member 90 in static convergence device 20, blue beam 70 is moved by a fixed amount and in a direction to offset the minimum magnitude motion produced by ring pair members 50 and 51. Corrector 90 will enable static convergence device 20 to converge blue beam 70 to within the acceptable distance for all various conditions of misconvergence encountered.

Consider the effect of corrector member 90 on the position of blue beam 70. As illustrated in FIG. 3, corrector 90 has a North pole at the 12 o'clock position producing the vertical motion 95 of FIG. 4. The effect on the blue beam is to move it to position 70A. Appropriate adjustment of ring pair members 50 and 51 then moves the blue beam by motion 96 onto the center beam 71. The resultant motion of the blue beam is motion 97. The four-pole corrector 90 also moves the red beam 72 by an equal and opposite amount to position 72A by means of motion 98. Appropriate rotation of ring pair members 40 and 41 then converges the red beam onto the center beam by means of motion 99, the resultant motion being motion 101.

Figure 5:
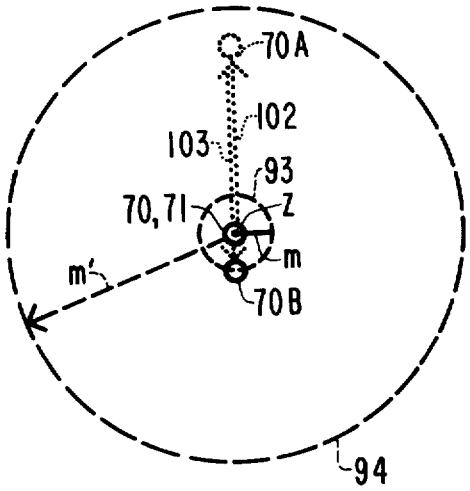

The pole strengths of corrector 90 are selected to provide a sufficient magnitude motion to the blue beam such that the required motion to be produced by ring pair members 50 and 51 will be equal to or greater than the minimum motion the ring pair is capable of producing. Consider an extreme situation such as illustrated in FIG. 5, where the blue beam 70 is already converged onto the center beam 71. Static convergence device 20 cannot impart a minimum magnitude motion less than $m'$. Without use of magnetic corrector 90, the position of blue beam 70 will be outside of circle 94. Corrector 90, illustratively with a North pole at the 12 o'clock position, imparts a motion 102 to the blue beam, the beam position being 70A. If the strength of the fixed magnetic field of corrector 90 is selected to impart a fixed magnitude motion equal to an amount $m' - m$, acceptable static convergence can be accomplished. Ring members 50 and 51 are rotated together until the direction of motion imparted on the blue beam is vertical and towards the center. With a North pole of ring member 50 substantially aligned with a South pole of ring member 51, the minimum motion $m'$ is effected, resulting in motion 103, the final blue beam position being 70B, providing for acceptable convergence. A similar procedure is preformed for the red beam, not shown.

If the magnitude of motion imparted on the blue beam by corrector 90 is equal to or greater than an amount $m'$, convergence of the blue beam directly onto the center beam is possible. However, it is not desirable for corrector 90 to impart more motion to the blue beam than the minimum needed to achieve acceptable convergence. In general, increased transverse motion of an electron beam will result in undesirable increased defocusing of the beam landing spot.

Figure 6:
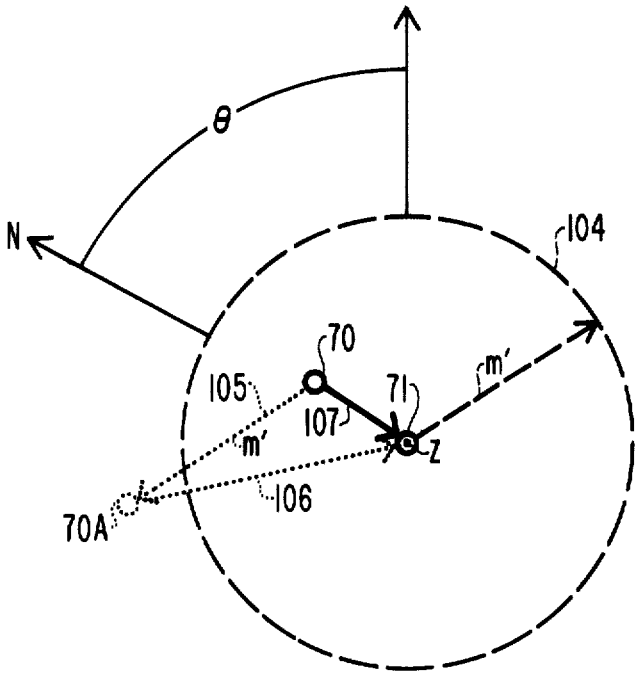

Although the examples illustrated in FIGS. 4 and 5 disclose a North pole of corrector 90 at the 12 o'clock position, any orientation of corrector 90 that will provide the appropriate offset motion may be selected. Consider the misconverged condition of FIG. 6, identical to the misconverged condition of FIG. 4. The center beam landing position 71 is illustratively on the Z-axis; the blue beam position is 70. The minimum motion that magnetic ring pair members 50 and 51 will produce is $m'$, and it is desired to converge the blue beam directly onto the center beam. In order to achieve convergence for all conditions of misconvergence encountered, the magnetic field strength of corrector 90 is selected to provide a magnitude of motion equal to $m'$.

Under these conditions, the direction of the magnetic field of corrector 90 is selected to move blue beam 70 outside the circle 104. Rotating a North pole of corrector 90 by an angle $\theta$ from the vertical results in motion 105, placing the blue beam in position 70A, which is outside circle 104. Appropriate rotation of ring pair members 50 and 51 coverages the blue beam onto the center beam by means of motion 106, the resultant motion being motion 107. Thus, the particular orientation of corrector 90 is important insofar as the orientation actually selected must provide a sufficient offset motion to enable the static convergence device to acceptably converge the electron beams.

Figure 7:
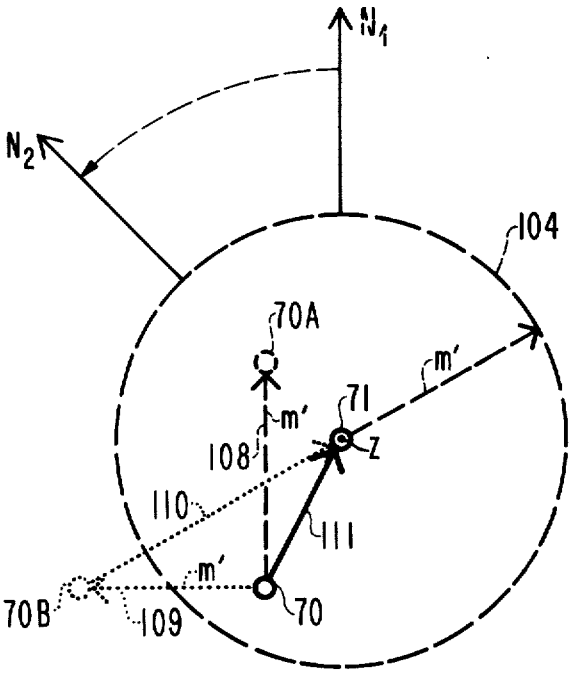

A feature of the invention is the rotational capability of corrector 90, thereby permitting the operator to select an appropriate orientation to the corrector for enabling convergence for all conditions of misconvergence encountered. For initial setup, an arbitrary orientation for corrector 90 is selected, e.g., the 12 o'clock position $N_1$ of FIG. 7. For many misconverged cathode ray tubes, such an orientation is adequate to provide the offset motion, if needed. For other misconverged tubes, such as in FIG. 7, the motion 108 produced by corrector 90 in the particular orientation selected is inadequate. The position of the blue beam is now at 70A rather than 70. This position is still within a distance $m'$ of the center beam, $m'$ being the minimum motion that ring pair members 50 and 51 must impart. If such a situation is encountered, corrector 90 is rotated by its tab 91, such that a North pole is at a new orientation $N_2$. The new motion 109 produced by corrector 90 now places the blue beam outside circle 104 at position 70B, providing sufficient offset motion to enable ring pair members 50 and 51, by appropriate rotation, to impart a motion 110 and converge the blue beam onto the center beam, the resultant motion being motion 111.

Thus, without the structure of adjustable magnetic corrector 90, static convergence device 20 can provide acceptable convergence only for selected conditions of misconvergence. With the structure, acceptable convergence can be obtained for all of the various conditions of misconvergence and with a minimum of beam defocusing.

Use of a magnetic corrector apparatus 90 eases the performance requirements imposed on the remaining structure of the static convergence device. Consider a cathode ray tube specification that requires the static convergence device to be capable of producing a maximum outer beam motion of M millimeters, and also requires that the static convergence device be capable of moving the outer beam to within $m$ millimeters of the center beam. The performance standard imposed may be expressed as the ratio $R = M/m$. Typical values may be $M = 4.572$mm, $m = 0.127$mm, for an R of 36:1. Such a ratio may be difficult to achieve in practice for certain cathode ray tube/static convergence device combinations, where $m$ may equal 0.762mm or more, for a ratio of 6:1 or less. By including a magnetic corrector apparatus of appropriate field strength, a large ratio R is obtainable even when a lower ratio static convergence device is used.

The static convergence device 20 will also be able to provide larger maximum beam motions when the magnetic corrector 90 is included. Consider the previous example, if convergence to within 0.127mm is desired, and the minimum motion produced is 0.762mm, the magnetic corrector 90 must be capable of providing a correcting motion $c$ of 0.635mm motion. This correcting motion $c$ can then by appropriate rotation of magnetic corrector 90 aid in statically converging cathode ray tubes misconverged by a distance greater than M. A new maximum of $M + c$ is available. Thus, for $M = 4.572$mm, the new maximum will be 4.572mm + 0.635mm = 5.207mm, and the new R will be 5.207mm/0.127mm = 41, which is larger than the previously mentioned R of 36.

Although magnetic corrector apparatus 90 is illustrated in FIG. 3 as a four-pole magnetic arrangement, other pole configurations such as six equiangularly spaced, alternating polarity poles with the appropriate pole strength may be used. A four-pole apparatus has an advantage of causing relatively little beam defocusing and relatively little net purity shift.

The invention may also be practiced using static convergence devices that include arrangements for moving the electron beams by other means than the eccentrically located ring members 40, 41, 50 and 51. For example, the invention may also be practiced using four-pole and six-pole concentrically located ring pairs producing opposite and like motions of the outer beams, as disclosed in the aforementioned Barbin, U.S. Pat. No. 3,725,831.

What is claimed is:

1. Static convergence apparatus for statically converging three electron beams within an envelope of a cathode ray tube, said electron beams subject to various conditions of misconvergence, comprising:

adjustable first magnetic convergence means suitable for locating about a portion of said envelope for producing within said envelope an adjustable first magnetic field, adjustment of said first magnetic field moving at least two of said three electron beams in directions and with magnitudes of motion that will converge said three electron beams to within a first distance of each other for selected conditions of misconvergence, said first magnetic convergence means producing a motion of minimum magnitude of at least a first one of said electron beams relative to a second one of said electron beams for all adjustments of said first magnetic field, wherein said first magnetic convergence means is unable to converge said first one and said second one of said electron beams to within said first distance for all of said various conditions of misconvergence; and adjustable magnetic corrector means suitable for locating about a portion of said envelope for producing a second magnetic field of fixed magnetic field strength and adjustable direction for effecting motion of a substantially fixed magnitude of said first one of said electron beams relative to said second one of said electron beams in a direction that will offset said motion of minimum magnitude produced by said first magnetic convergence means for enabling said first magnetic convergence means to converge said first one and second one of said electron beams to within said first distance for all of said various conditions of misconvergence.

2. Apparatus according to claim 1 wherein said first and second electron beams comprise the outer beams of three in-line electron beams.

3. Apparatus according to claim 2 wherein said adjustable magnetic corrector means comprises a single rotationally adjustable magnetic ring member magnetized to produce a four-pole magnetic field of fixed magnetic field strength.

4. Apparatus according to claim 2 wherein said adjustable first magnetic convergence means comprises:

first magnetic field producing means rotationally adjustable about said portion of said envelope and including a first zero magnetic field point located within said envelope between the central beam and the second outer beam for effecting movement of said first outer beam in any direction with substantially no movement of said central and second outer beams; and second magnetic field producing means rotationally adjustable about said portion of said envelope and including a second zero magnetic field point located within said envelope between the central beam and the first outer beam for effecting movement of said second outer beam in any direction with substantially no movement of said central and first outer beams.

5. Apparatus according to ciaim 4 wherein at least one of said first and second magnetic field producing means comprises a pair of magnetic ring members, each ring member producing a six-pole magnetic field.

6. Apparatus according to claim 5 wherein said adjustable magnetic corrector means comprises a single rotationally adjustable magnetic ring member producing a four-pole magnetic field of fixed magnetic field strength.

* * * * *